United States Patent [19]

Brak et al.

[11] Patent Number: 4,489,538

[45] Date of Patent: Dec. 25, 1984

[54] BAG-OUT MATERIAL HANDLING SYSTEM

[75] Inventors: Stephen B. Brak, Tinley Park; Henry F. Milek, Chicago, both of Ill.

[73] Assignee: The United States of America as represented by the Department of Energy, Washington, D.C.

[21] Appl. No.: 352,743

[22] Filed: Feb. 26, 1982

[51] Int. Cl.[3] ..... B65B 43/42

[52] U.S. Cl. ..... 53/576; 53/567; 53/577; 17/49

[58] Field of Search ..... 17/35, 37, 38, 41; 53/567, 575, 576, 577

[56] References Cited

U.S. PATENT DOCUMENTS

| | | | |
|---|---|---|---|
| 872,231 | 11/1907 | Hambruch | 17/37 |
| 2,656,658 | 10/1953 | Grady | 53/576 |
| 2,908,123 | 10/1959 | Muller et al. | 53/567 X |
| 3,039,001 | 6/1962 | Park et al. | 250/108 |
| 3,203,807 | 8/1965 | Sloan et al. | 17/35 X |
| 3,412,523 | 11/1968 | Raymond et al. | 53/197 |
| 3,461,640 | 8/1969 | Bonami | 53/3 |
| 3,529,401 | 9/1970 | Sartore et al. | 53/197 |
| 3,657,861 | 4/1972 | Soodalter | 53/197 |
| 3,885,053 | 5/1975 | Townsend | 17/35 X |
| 3,938,300 | 2/1976 | Lövquist | 53/576 |
| 3,942,023 | 3/1976 | Flaugnatti | 250/515 |
| 3,945,171 | 3/1976 | Marietta, Jr. et al. | 53/512 X |
| 3,975,795 | 8/1976 | Kupcikevicius et al. | 17/41 |
| 4,006,362 | 2/1977 | Mollon et al. | 250/518 |
| 4,023,238 | 5/1977 | Phares | 53/576 X |
| 4,090,087 | 5/1978 | Weissenfluh | 250/519 |
| 4,155,212 | 5/1979 | Marchese | 53/258 |
| 4,307,489 | 12/1981 | Niedecker | 17/41 X |

FOREIGN PATENT DOCUMENTS

| | | | |
|---|---|---|---|
| 508350 | 7/1971 | Switzerland | 17/35 |
| 743665 | 6/1980 | U.S.S.R. | 17/35 |

*Primary Examiner*—Robert L. Spruill
*Assistant Examiner*—Steven P. Weihrouch
*Attorney, Agent, or Firm*—Hugh W. Glenn; Robert J. Fisher

[57] ABSTRACT

A bagging device for transferring material from a first chamber through an opening in a wall to a second chamber includes an outer housing communicating with the opening and having proximal and distal ends relative to the wall. An inner housing having proximal and distal ends corresponding to those of the outer housing is mounted in a concentrically spaced, sealed manner with respect to the distal end of the outer housing. The inner and outer housings and mounting means therebetween define an annular chamber, closed at its distal end and open at its proximal end, in which a pliable tube is slidably positioned in sealed engagement with the housings. The pliable tube includes a sealed end positioned adjacent the proximal end of the inner housing so as to maintain isolation between the first and second chambers. Displacement of the material to be bagged from the first chamber along the inner housing so as to contact the sealed portion of the pliable bag allows the material to be positioned within the pliable bag in the second chamber. The bag is then sealed and severed between where the material is positioned therein and the wall in providing a sealed container for handling the material. The pliable tube when substantially depleted slides onto a narrow portion of the inner housing to allow a new pliable tube to be positioned over the old pliable tube. Remnants of the old pliable tube are then discharged into the new pliable tube with the bagging and removal of additional material.

12 Claims, 5 Drawing Figures

BAG-OUT MATERIAL HANDLING SYSTEM

CONTRACTUAL ORIGIN OF THE INVENTION

The U.S. Government has rights in this invention pursuant to U.S. Contract No. W-31-109-ENG-38 between the U.S. Department of Energy and Argonne National Laboratory.

CROSS REFERENCE TO RELATED APPLICATION

The present invention is related to co-pending U.S. patent application Ser. No. 340,625, entitled IMPROVED MATERIAL BAGGING DEVICE, filed Jan. 19, 1982, in the names of Charles G. Wach, Robert E. Nelson and Stephen B. Brak, and to co-pending U.S. patent application Ser. No. 352,749, entitled BAG-OUT MATERIAL HANDLING SYSTEM, filed Feb. 26, 1982, in the name of Stephen Brak, the disclosures of which are expressly incorporated herein by reference.

BACKGROUND OF THE INVENTION

The present invention relates generally to a bagging device and, more specifically, to a device for use in transferring contaminated material through a wall from a contaminated chamber to a clean chamber from which contaminated gas and dust are substantially excluded.

The present invention affords improvements over the bag-out port design disclosed in the co-pending patent application entitled IMPROVED MATERIAL BAGGING DEVICE by inventors Charles G. Wach, Robert E. Nelson and Stephen B. Brak. Bag-out ports are of considerable importance in the nuclear industry where contaminated substances must be transferred from one chamber to another without the release of contaminated gas or material into the atmosphere or immediate area. The transfer of contaminated materials is complicated due to high levels of radiation which mandate the use of remote manipulators.

Prior art bag-out ports typically include a port structure to which a plastic bag is secured by hose clamps. After contaminated material is deposited in the plastic bag and port structure, the hose clamp is released using a screwdriver and a new plastic bag is then stretched over the port. This bagging operation is difficult to perform with remote manipulators, time consuming and expensive.

The above referenced co-pending application of Wach, et al, discloses a structure which provides for the continuous dispensing of a pleated pliable tube from a rigid support cartridge positioned in an aperture of a wall separating the two chambers. The pliable tube is sealable at one end, closing the opening between the chamber. Material deposited in the pliable tube is sealed within a portion which is severed from the remainder of the pliable tube while maintaining a sealed relationship between the two chambers. Waste remnants of the cartridge and pliable bag are deposited in the contaminated chamber.

SUMMARY OF THE INVENTION

The present invention provides for the safe replacement of the bagging material in a bagging device for remotely handling contaminated materials, and eliminates the discharge of the depleted transfer elements into the contaminated chamber.

The present invention contemplates a bagging device for transferring material from one chamber through an opening in a wall to a second chamber. The bagging device includes an outer housing having open proximal and distal ends with respect to the wall, communicating with the opening at its proximal end. An inner housing having corresponding open proximal and distal ends is spaced concentrically within the outer housing. Mounting means sealably secure the inner housing to the outer housing at their respective distal ends, closing the distal end of the outer housing and defining an annular chamber between the inner and outer housings which is open at the proximal end of the housings. The inner housing is wider having a larger outer circumference at its distal end than at its proximal end portion. A bagging material such as a pleated, pliable tube in combination with means for slidably engaging it in sealed relationship with the inner housing is disposed within the annular space on the widened portion of the inner housing. The sealed end of the pliable tube is positioned over the proximal open end of the inner housing so as to isolate the second chamber from the first chamber.

In operation, with the pliable tube sealably closed over the proximal end of the inner housing, the tube receives material from the first chamber with the sealed portion of the tube then displaced out from the housings into the second chamber where it is then first sealed and then severed so as to enclose the material in the sealed portion of the pliable tube forming a bag-like container. The pliable tube remains sealably closed over the open proximal end of the inner housing. The bag-out port system of the present invention prevents the transfer of air and dust between chambers and allows the pliable tube to receive additional contaminated material without necessitating tube replacement.

The pliable tube, when substantially depleted, slides onto the narrow portion of the inner housing to allow a new pliable tube to be positioned over the old pliable tube and to be slidably positioned on the expanded portion of the inner housing. The new pliable tube is extended over the old pliable tube and the proximal end of the inner housing where it is closed and sealed. New material, being transferred through the inner housing, removes the remnants of the old pliable tube from the narrow portion of the inner housing and extends the new pliable tube into the second, or clean chamber. The old pliable tube and the newly deposited material are then sealed in the new pliable tube as described previously.

Thus the present invention provides a bagging device which allows for the transfer of material from a first chamber to a second chamber through an opening in a dividing wall while maintaining a sealably closed relationship between the chambers. The bagging material can be replaced and removed from the second, clean chamber without any discharge of waste material from the contaminated chamber.

Other features and advantages of the present invention will be apparent from the following description and claims and are illustrated in the accompanying drawings which, by way of illustration, show preferred embodiments of the present invention and the principles thereof and what is now considered to be the best mode in which to apply these principles. Other embodiments of the invention embodying the same or equivalent principles may be used and structural changes may be made as desired by those skilled in the art without departing from the present invention and the purview of the appended claims.

DESCRIPTION OF THE PREFERRED EMBODIMENT

Figure 1:
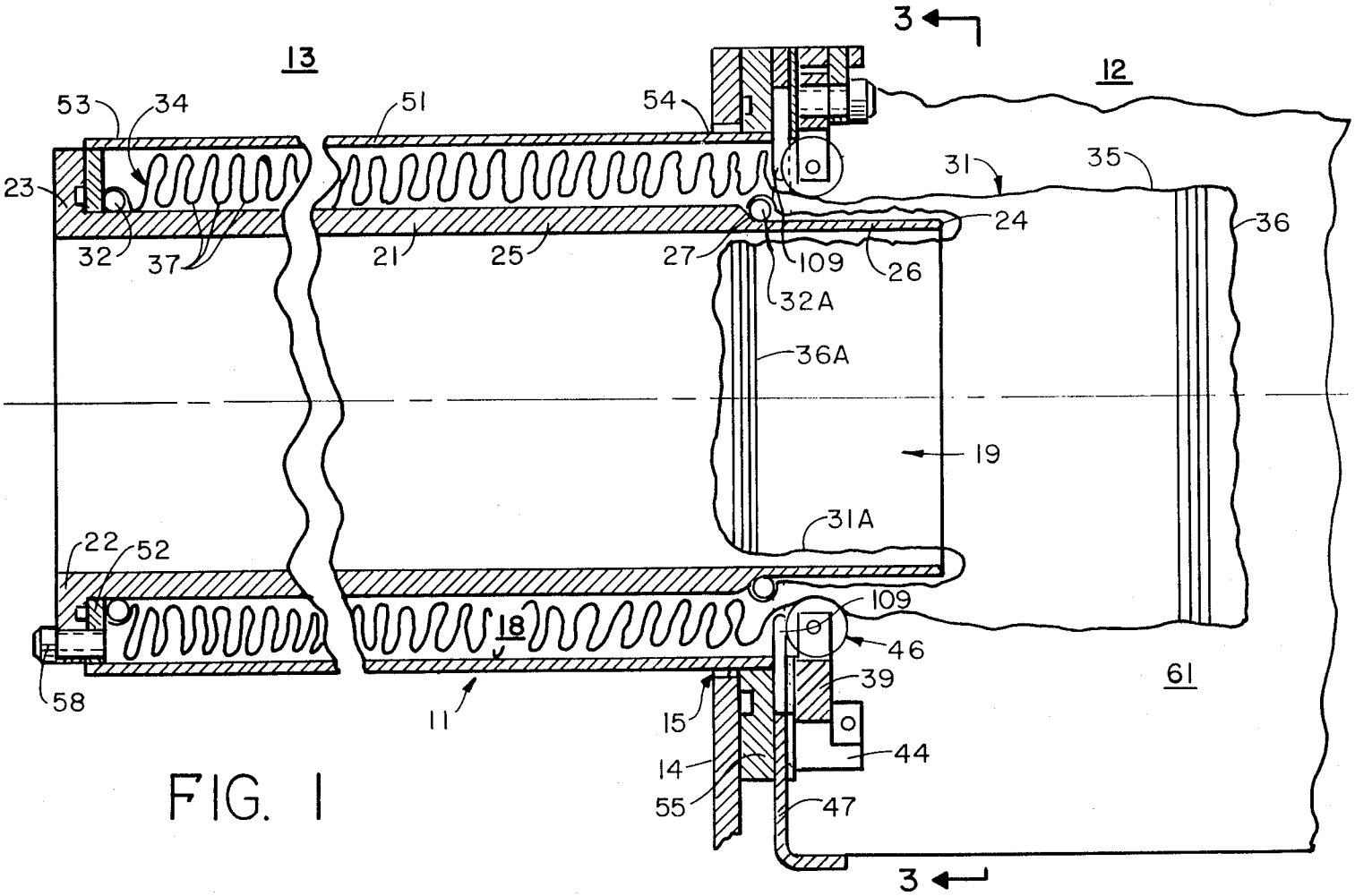
FIG. 1 is a sectional top view of a bagging device embodying the principles of the present invention.

The present invention will be described in detail as a bagging device for transferring radioactive material from an area of high level radiation to an area of low level radiation, with the understanding that the present disclosure is to be considered as an exemplification of the principles of the invention and is not intended to limit the embodiment illustrated. Thus, the bagging device of the subject invention, generally designated by numeral 11 as best seen in FIG. 1, is shown mounted in the aperture 15 of a wall 14, which separates a first contaminated chamber 13 from a second clean chamber 12. The bagging device 11 is comprised of the following major elements: an inner housing 21, an outer housing 51, and bagging means such as pliable tube 31.

The inner housing 21, outer housing 51 and the pleated, pliable bag 31 may have any cross-sectional shape, however, it is relatively easy to obtain the necessary sealed relationship between the various components of the present invention when they have a circular cross-sectional shape. Therefore, the present invention is described with regard to a bagging device where the major elements have a circular cross-sectional shape.

The outer housing 51 has a distal end 53 extending into the contaminated chamber 13 and a proximal end 54 communicating with opening 15. A rim 55 is mounted by suitable means such as welding to the proximal end 54 of the outer housing 51. The outer housing 51 is secured to the wall 14 by means of bolts 56, see FIG. 3, extending through the rim 55 and threadably received into holes in the wall 14. While FIG. 1 shows outer housing 51 mounted to wall 14 at one of its ends, outer housing may be mounted to wall 14 at any point along its length in practicing the present invention.

An inner housing 21 is positioned in a concentrically spaced relationship within the outer housing 51. The inner housing 21 has an open proximal end 24 and an open distal end 23 corresponding to the proximal and distal ends 54, 53 of outer housing 51. Mounting means for sealably securing the inner housing 21 to the outer housing 51 includes an outwardly extending flange or ridge 22 at the distal end 23 of the inner housing 21 which is secured to an inwardly extending flange 52 of the outer housing 51 by means of bolts 58. Thus, the inner and outer housings 21, 51 define an annular chamber 18 therebetween closed at the respective distal ends 23, 53 and open at the respective proximal ends 24, 54 of the housings 21, 51. The inner housing 21 further defines a passage 19 extending therethrough from the contaminated chamber 13 to the clean chamber 12.

The inner housing 21 has a narrowed portion 26 of reduced outer circumference proximately located with respect to and separated by means of a tapered section 27 from a wider portion 25 of inner housing 21.

A pliable tube 31 of bagging material having a distal end 34 and a proximal end 35 is secured by O-ring retainer 32 at its distal end 34 to the wide portion 25 of the inner housing 21. The O-ring retainer 32 elastically contracts about the inner housing 21 in a sealed manner. The proximal end 35 of the pliable tube 31 extends outwardly beyond housings 21, 51 to a sealed closure portion 36 which prevents the movement of atmosphere and dust through the passage 19 of the inner housing 21 between the contaminated chamber 13 and the clean chamber 12. The pliable tube 31 is collapsed upon itself forming pleats 37 allowing a substantial length of bagging material to be stored in a small area. The pleats 37 can be molded or formed as an integral part of the pliable tube. An embodiment of the present invention includes alternating narrow and wide bands which can be pleated together in accordion-like fashion.

Temporarily disregarding the second pliable tube designated by numeral 31A, material from the contaminated chamber 13 is received within passage 19, pushed through towards the proximal end 24 of the inner housing 21, and into the proximal end 35 of the plastic tube 31. As the material is pushed further into the clean chamber 12, the pleated, pliable tube 31 unfolds and extends outwardly from the housings 21, 51. The pliable tube 31 is then first heat sealed and then severed along the seal leaving the severed portion closed about the contaminated material in a bag-like manner, and the remaining portion of the tube 31 is sealably closed about the open proximal end 24 of the inner housing 21 thereby preventing movement of atmosphere and dust between the contaminated and clean chambers 13, 12.

Dispensing means 46 is secured to the rim 55 of the outer housing 51 to facilitate the unfolding and movement of the pliable tube 31 outwardly from the inner and outer housings 21, 51. The dispensing means 46 is discussed in greater detail below.

A bag support means such as platform 61 extends outwardly from below the inner and outer housings 21, 51 to provide support for the pliable tube 31 and the material that may be contained therein during the sealing and cutting operation.

When the pliable tube 31 has been substantially depleted from inner housing 21, the further introduction of material into the pliable tube slidably displaces the remnants of the pliable tube 31 and O-ring retainer 32 along the wide portion 25 of inner housing 21, past the tapered portion 27 thereof, to the narrow portion 26. The remnants of the old pliable tube 31 are generally designated by the letter A. Thus, the O-ring retainer 32A of the depleted pliable tube 31A is positioned on the narrow portion 26 of inner housing 21. After the material has been sealed in a section of the pliable tube 31, the tube severed, and the bag-like enclosure removed, the closure 36A and the proximal end 31A of the tube are tucked out of the way within passage 19 of the inner housing 21. As will be discussed in detail below, the roller assembly portion of dispensing means 46 can be positioned away from the annular space 18 to facilitate the insertion of a new pliable tube 31 therein.

The replacement pliable tube 31 is open at the distal end 34 thereof and positioned over the distal end 23 of inner housing 21 and O-ring retainer 32A of the old pliable tube 31A which is recessed on narrow portion 26. After the new pliable tube 31 has been mounted, its proximal end 35 is extended over the old pliable tube 31A and the proximal end 24 of the inner housing 21 and sealably closed forming closure 36. The remnant of the old pliable tube 31A is pulled off the narrow portion 26 of the inner housing 21 as new material is pushed through the passage 19 towards the clean chamber 12. The remnant of the old pliable tube 31A is sealed within a portion of the new pliable tube with the new material being transferred. Thus, waste remnants of the bagging device are not discharged into the contaminated chamber 13 but are removed into the clean chamber.

Figure 2:
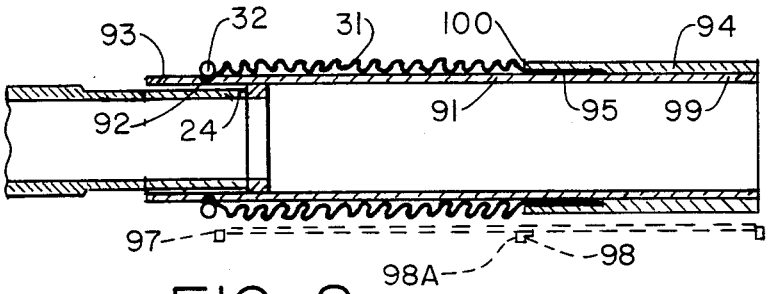
FIG. 2 is a sectional side view of a loading sleeve and a fractional portion of the bagging device incorporating the principles of the present invention.

Referring now to FIG. 2, a pliable tube 31 is shown being loaded on the proximal end 24 the of inner housing by means of a loading sleeve 91 and pusher cylinder 94. The loading sleeve has a distal end 93 and a proximal end 99 corresponding to those of inner and outer housings. The loading sleeve 91 has a cylindrical shape of sufficient diameter to allow it to extend concentrically around the wide portion of inner housing. An end stop distally positioned in the form of a groove 92 in loading sleeve 91 receives and secures the O-ring retainer 32 in holding the pliable tube 31 in place. A pusher cylinder 94 is slidably mounted around the loading sleeve 91. The pusher cylinder 94 has an indentation 95 releasably securing a portion of the pleated pliable bag 31 therein between the pusher cylinder 94 and the loading sleeve 91. A compression face 100 on pusher cylinder 94 compresses the pliable bag 31 as the pusher cylinder is moved towards groove 92, forcing the O-ring retainer 32 out of groove 92 and off the loading sleeve 91 onto the expanded portion of the inner housing. After the O-ring retainer 32 is sealably engaged on the surface of the inner housing, the loading sleeve 91 and pusher cylinder 94 are withdrawn from the annular space surrounding the inner housing and the proximal end of the pliable tube is closed and sealed to form a closure.

Alternatively, as shown in dotted line form in FIG. 2, the loading sleeve 91 may have an outward projection forming an end stop 97 and slidable compression ring 98 having a flat compression surface 98A. A pleated pliable bag can be mounted upon the loading sleeve 91, between the end stop 97 and the slidable compression ring 98, with the O-ring retainer 32 against the end stop 97. A force exerted against the compression ring 98 displaces ring 98 against the pliable tube 31 until O-ring retainer 32 is popped over the end stop 97 and onto the expanded portion 25 of the inner housing 21. After the O-ring 32 retainer is sealably engaged on the surface of the inner housing 21, the loading sleeve 91 and abutment ring 98 are withdrawn from the annular space 18, and the proximal end 35 of the pliable tube 31 is then closed and sealed to form closure 36.

Figure 5:
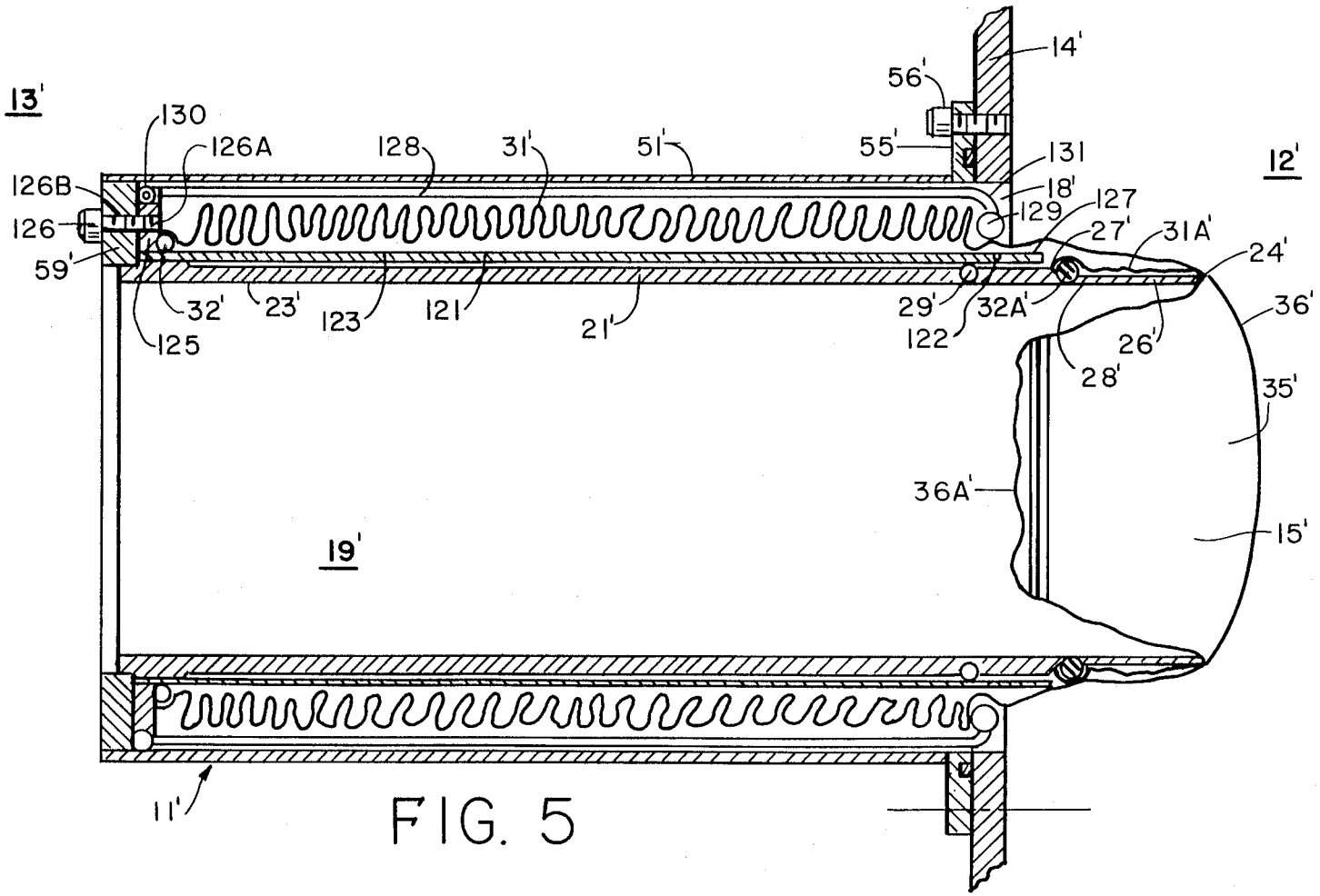
FIG. 5 is a sectional side view of an alternate emobodment of a bagging device embodying the principles of the present invention.

Another embodiment of the present invention is illustrated in FIG. 5, where similar numerical designations are used to indicate similar structural features previously described. Thus, an outer housing 51' in communication with opening 15' is mounted to wall 14' by means of a rim 55' and bolts 56'. An inner housing 21' is secured to the outer housing in a concentrically spaced relationship by means of an end ring 59' to which the inner and outer housings 21' and 51', respectively, are secured by suitable means such as welding.

A rigid hollow loading sleeve 121 having a distal end 123 and a proximal end 127 is slidably received on the inner housing 21 within the annular space 18'. An O-ring seal 29' mounted towards the proximal end 24' of the inner housing 21' provides a sealed relationship between the inner housing 21' and the loading sleeve 121. The loading sleeve 121 extends from the distal end 23' to the tapered portion 27' of the inner housing 21'. A flange 125 extends outwardly from the distal end 123 of the loading sleeve 121. Means to secure the loading sleeve 121 to the inner and outer housings 21', 51' include a bolt 126 extending through hole 126B in end ring 59' and threadably received in hole 126A in the flange 125.

A pliable tube 31' is concentrically mounted upon the outer surface of the loading sleeve 121. An O-ring retainer 32' slidably secures the pleated pliable tube at the distal end 123 of the loading sleeve 121. Retaining arms 128 are pivotally mounted to the loading sleeve 121 by means of a pivot 130 mounted on the outer circumference of flange 125. The retaining arms 128 extend substantially the length of the loading sleeve 121 and have a terminal end portion having a smooth, snag-resistant surface in the form of a ball 129 acting as a tube retaining means. The retaining arms 128 can be pulled inwardly against the loading sleeve 121 where they rest in indentations 122 on the surface of the loading sleeve 121 to prevent the collapsed pliable tube 31' from unfolding and extending off loading sleeve 121.

In operation, the loading sleeve 121, with a pliable tube 31' slidably mounted thereupon, is itself slidably received upon inner housing 21' in a sealed relationship. The retaining arms 128 prevent the pliable tube 31' from extending and unfolding off the loading sleeve 121 when the pliable tube is not in use, such as during storage and loading operations. The retaining arms 128 are released allowing the collapsed pliable tube 31' to unfold and extend outwardly from the inner and outer housings 21', 51' where the pliable tube 31' can be sealed forming closure 36', thereby preventing the transfer of air and dust between the respective contaminated and clean chambers 13', 12'. Contaminated material from the contaminated chamber 13' is inserted at the open distal end 24' of the inner housing 21', pushed through passage 19' and against closure 36'. Continued movement of the material extends the pliable tube 31' from the inner and outer housings 21', 51'. The portion of the tube containing the contaminated material is sealed creating a closed bag-like structure around the contaminated material. The pliable tube 31' can then be severed about the seal in a manner to maintain a closure 36' at the proximal end 35' of the tube 31' and the closed bag-like enclosure around the contaminated material.

When the pleated, pliable tube 31' is substantially depleted from the loading sleeve 121, new material entering the passage 19' and pushing against the closure 36' causes the pleated, pliable tube to slidably withdraw the O-ring retainer 32' from the loading sleeve 121 towards the tapered portion 27' thereof and retaining groove 28' on the inner housing 21'. The O-ring retainer 32' is slidably received in the retaining groove 28' extending around the narrow portion 26' of the inner housing 21'. The remnants of the pliable tube 31' are tucked out of the way into the passage 19' within the inner housing 21'. The empty loading sleeve 121 can be withdrawn from the annular space 18' by releasing the bolt 126 securing flange 125 to ring 59.

After the old loading sleeve has been removed from the inner housing 21', a new loading sleeve with a new pliable tube 31' can be inserted over the old pliable tube 31A' and O-ring retainer 32A'. The proximal end portion of the pliable tube 31', which is open during the loading process, is withdrawn from the loading sleeve 121, extended over the narrow projecting portion 26' of the inner housing 21', closed and sealed forming closure 36'. New contaminated material moving through passage 19' abuts against the old pliable tube 31A' at closure 36A' and withdraws the old pliable tube 31A' from the narrowed projecting portion 26' of the inner housing 21', pulling O-ring retainer 32A' out of the retaining groove 28', and sliding the remnant of the pliable tube 31A' off the inner housing 21' as the new pliable tube extends to receive the new material. The old pliable tube 31A' is thus discharged into the clean chamber 12' and can be sealed within a portion of the new pleated, pliable tube 31' containing the new contaminated material. The old loading sleeve 121 is liquid sonic cleaned and sent out of the cell to be reloaded with a new pliable tube 31'.

The tube dispensing means (not shown) can be mounted about annular space 18' of the bag-out device 11' illustrated in FIG. 5 in a manner described in regard to FIG. 1. Alternate embodiments of the dispensing means 46 are further described with reference to FIGS. 3 and 4.

Figure 3:
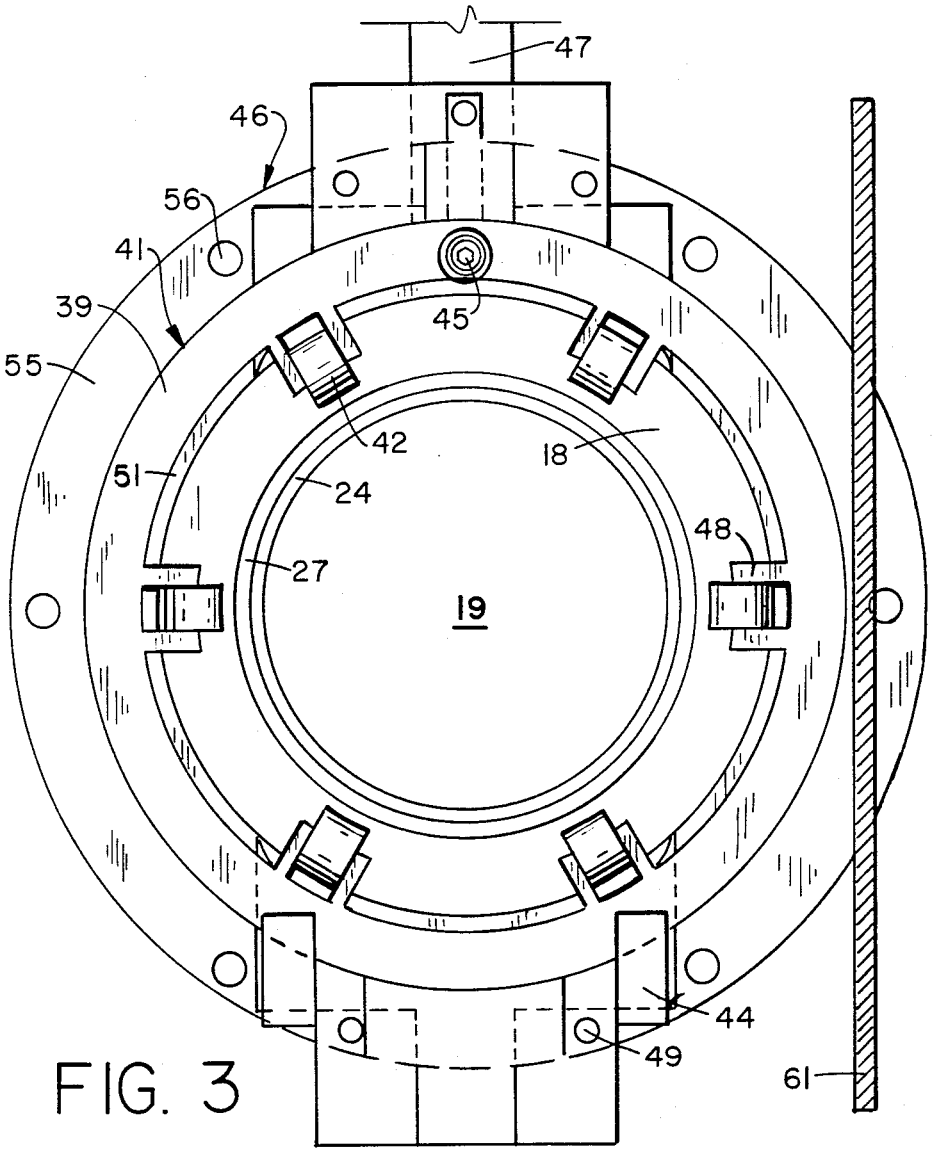
FIG. 3 is a front view partly in section of a bagging device and the bag dispensing means with the bag removed incorporating the principles of the present invention on the line 3—3 of FIG. 1.

Referring now to FIG. 3, the dispensing means 46 is comprised of a hinged roller assembly 41 having wheels 42 rotatably mounted on axles (not shown) secured to inwardly projecting braces 48 arranged in a spaced manner about bracket 39. Bracket 39 is secured to the rim 55 of the outer housing 51 by means of a hinge 44 which allows the hinged roller assembly 41 to swing open leaving the annular space 18 unobstructed. Hinge 44 is secured to rim 55 by means of screws 49 extending through the hinge 44 and threadably received in holes in rim 55. The hinged roller assembly 41 is secured in a closed position by bolt 45 extending through the bracket 39 and also threadably received in a hole in rim 55.

Captivated retaining bars 47 are interposed and slidably mounted between bracket 39 and rim 55. The retaining bar has a curved abutment surface 109 (FIG. 1) corresponding to the curvature of the projecting narrow portion 26 of the inner housing 21. As best seen in FIG. 1, the retaining bar 47 can be extended into the annular space 18 against the narrow projecting portion 26 of the inner housing 21 such that the abutment surface 109 engages the old pliable tube 31A and the O-ring retainer 32A to prevent the old pliable tube 31A from being pulled off. Although not shown in FIG. 5, bars similar to those shown at 47 will be used to prevent removal of the old tube 31A in the FIG. 5 embodiment.

Referring now to FIG. 1, opening the retaining bars 47 and hinged roller assembly 46 removes obstructions from the annular space 18 to facilitate the insertion of a new pliable tube 31. After the new tube has been mounted and closure 36 has been formed, hinged roller assembly 46 can be closed to facilitate dispensing of pliable tube 31. After the old pliable tube 31A has been discharged, retaining bars 47 can again be closed to prevent the new tube 31 from being pulled off the inner housing 21.

Figure 4:
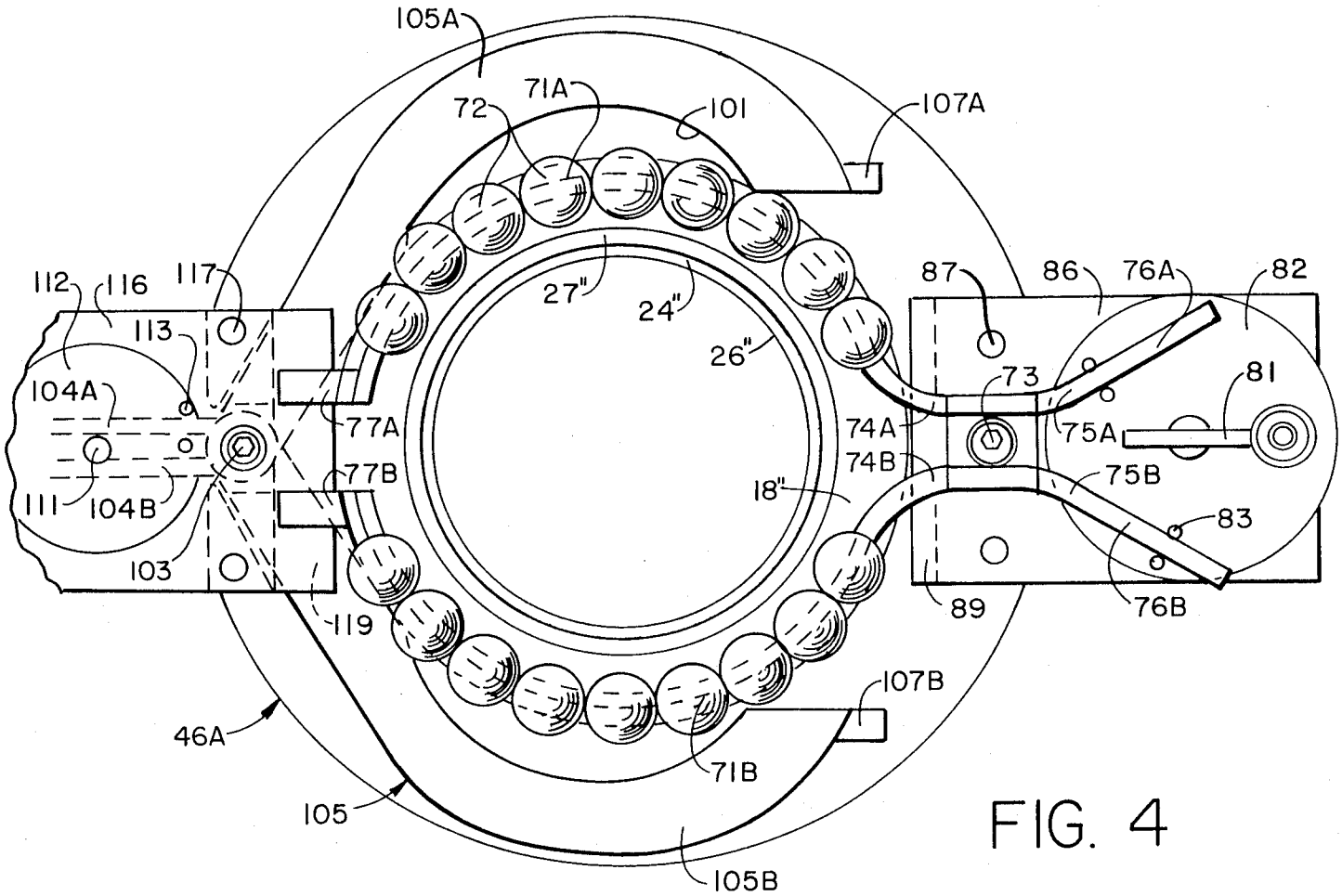
FIG. 4 is a front view of a bagging device and bag dispensing means incorporating the principles of the present invention.

An alternate dispensing means 46A having upper and lower wire supports 71A and 71B, respectively, encircling the narrow projecting portion 26' of the inner housing is illustrated in FIG. 4. Wheel means such as bead-like balls 72 with pivot holes are rotatably mounted upon wire supports 71A and 71B. Each wire support 71A and 71B extends radially outward from the housings to form an upper and lower arm portion 74A and 74B, respectively. The arms 74A and 74B of the wire supports 71A and 71B are rotatably mounted to wire support bracket 86 at pivot 73 and diverge at bends 75A and 75B to form upper and lower levers 76A and 76B, respectively, The levers 76A and 76B of arms 74A and 74B are engaged in projections 83 extending from rotatable turntable 82. Turntable 82 is rotatably mounted to wire support bracket 86 which is secured to the wall 14 or rim 55 of the outer housing 51 (FIG. 1). A knob 81 facilitates the manual rotation of the turntable 82.

On the opposite end of the wire supports 71A and 71B are securing fingers 77A and 77B extending radially outward to engage in a slot 119, shown in phantom, in the retaining ring bracket 116.

Rotation of knob 81 in a clockwise direction shifts the projections 83 of turntable 82 to a horizontal position forcing levers 76A and 76B of the upper and lower arms 74A and 74B together, forcing the upper and lower arms 74A and 74B together, causing the upper and lower wire supports 71A and 71B to diverge radially outward from around the narrow projecting portion 26' of the inner housing. Counterclockwise rotation forces the positions of the projections away from the horizontal axis of turntable 82 forcing levers 76A and 76B apart and causing the upper and lower wire supports 71A and 71B to close.

An expandable retaining ring 105 is interposed between the wire and ball assembly 80 and the wall 14'. The expandable retaining ring 105 has upper and lower abutment members 105A and 105B, respectively, having abutment surfaces 101 corresponding to the curvature of the narrowed portion 26' of the inner housing 21'. The abutment members 105A and 105B are rotatably secured to ring bracket 116 at ring pivot 103.

The upper and lower abutment members 105A and 105B, respectively, extend radially outwardly from the housings forming upper and lower ring arms 104A and 104B, respectively. Ring arms 104A and 104B extend radially outward from the curvature of the abutment members 105A and 105B and engage ring projections 113 on ring turntable 112.

Rotation of ring knob 111 rotates turntable 112 and shifts ring projections 113 to a horizontal position on ring turntable 112 forcing the upper and lower ring arms 104A, 104B together. This expands and opens the upper and lower abutment members 105A and 105B in a similar manner to dispensing means 46A. Rotation in a counterclockwise direction forces ring arms 104A, 104B apart closing the upper and lower abutment members 105A, 105B tightly against the outer diameter of the narrowed projecting portion 26'' of the inner housing to prevent O-ring retainer 32 from sliding off the inner housing.

On the end of the upper and lower abutment members 105A, 105B, opposite ring arms 104A and 104B are upper and lower ring protrusions 107A and 107B aligned with ring slot 89, illustrated in phantom. Ring slot 89 secures the end portions of the upper and lower abutment members 105A and 105B against outward forces.

Referring now to FIG. 4, opening the expandable retaining ring 105 and the wire supports 71A and 71B removes obstructions from the annular space 18" to facilitate the insertion of a new pliable tube. After the new tube has been mounted and closure has been formed, wire supports 71A and 71B and retaining ring 105 can be closed to facilitate the dispensing of the new pliable tube and to prevent the accidental removal of the bag material from the inner housing.

From the foregoing it will be seen that the present invention provides an improved contaminated material remote handling system permitting the bagging material to be safely and easily replaced and increasing the number of material handlings before replacement of the bag means is necessary, thus decreasing the cost of transfer operations. Further, the present invention provides a contaminated material bagging apparatus in which a minimum of waste material is produced and wherein the waste material is discharged towards the clean chamber.

Thus, while the preferred embodiment has been illustrated and described, it is understood that this is capable of variation and modification, and therefore the present invention sould not be limited to the precise details set forth, but should include such changes and alterations as fall within the purview of the following claims.

The embodiments of the invention in which an exclusive property or privilege is claimed are defined as follows:

1. A bagging device for transferring material from a first chamber through an opening in a wall to a second chamber, said bagging device comprising:

an outer housing having open proximal and distal ends, said proximal end communicating with said opening;

an inner housing spaced concentrically within said outer housing so as to define an anular space therebetween, said inner housing having open proximal and distal ends so as to define a passage between said first and second chambers and wherein the circumference of the proximal end of said inner housing is smaller than the circumference of the remaining portion thereof;

means for sealably coupling the respective distal ends of said inner and outer housing in sealing said annular space at the distal portion thereof and wherein the proximal end portion of said annular space is open; and a pliable tube slidably engaged in sealed relationship with said inner housing and disposed thereon within said annular space, said pliable tube including a first closed end portion extending from the open proximal end portion of said annular space and over the proximal end of said inner housing in sealed relation thereto for receiving material from said first chamber through said inner housing, wherein the closed proximal portion of said tube is sealed and severed along said seal in providing a sealed container for handling said material while forming a second closed end portion extending over the proximal end of said inner housing in maintaining isolation between said first and second chambers and wherein the reduced circumference of the proximal end of the inner housing facilitates the removal of the remnants of a used tube and the installation of a replacement tube with the remnants of the used tube discharged into the sealed, installed replacement tube.

2. The bagging device of claim 1 including resilient ring means positioned in said annular space and tightly engaging the distal end of said inner housing with said pliable tube positioned between said inner housing and said ring means in sealed engagement therebetween.

3. The bagging device of claim 1 wherein said pliable tube has alternating narrow and wide circumferential areas forming pleats, said pleats allowing said tube to collapse upon itself for placement in said annular space and to expand and extend from the proximal end of said inner housing into said second chamber.

4. The bagging device of claim 1 further including material support means positioned immediately adjacent the lower portion of the proximal end of said inner housing and extending from said wall into the second chamber for receiving and supporting material deposited in said pliable tube with said tube extended from said inner housing in facilitating the severing and sealing of said tube.

5. The bagging device of claim 1 further comprising tube dispensing means including a plurality of wheel means positioned in a spaced manner about the proximal end of said inner housing immediately adjacent said annular space.

6. The bagging device of claim 5 wherein said plurality of wheel means are secured to a hinged bracket, said bracket pivotally mounted to said outer housing by hinge means to allow said bracket to pivot away from said annular space to facilitate the insertion of a replacement pliable tube therein.

7. The bagging device of claim 5 wherein each of said wheel means is secured to axle support means, said plurality of axle support means encircling said inner housing and pivotally coupled to the proximal end of said outer housing wherein said axle support means swing radially outward from said inner housing and away from said annular space to facilitate the insertion of a replacement pliable tube in said annular space.

8. A bagging device for transferring material from a first chamber through an opening in a wall to a second chamber, said bagging device comprising:

an outer housing having open proximal and distal ends, said proximal end communicating with said opening;

an inner housing spaced concentrically within said outer housing so as to define an annular space therebetween, said inner housing having open proximal and distal ends so as to define a passage between said first and second chambers;

means for sealably coupling the respective distal ends of said inner and outer housing in sealing said annular space at the distal portion thereof;

a pliable tube slidably engaged in sealed relationship with said inner housing and disposed thereon within said annular space, said pliable tube including a first closed end portion extending over the proximal end of said inner housing in sealed relation thereto for receiving material from said first chamber through said inner housing, wherein the closed proximal portion of said tube is sealed and severed along said seal in providing a sealed container for handling said material while forming a second closed end portion extending over the proximal end of said inner housing in maintaining isolation between said first and second chambers; and tube dispensing means including a plurality of wheel means secured to respective axle support means positioned in a spaced manner about the proximal end of said inner housing immediately adjacent said annular space and secured to a hinged bracket, said bracket pivotally mounted to said outer housing by hinge means to allow said bracket and said wheel means and axle support means combination to pivot away from said annular space to facilitate the insertion of a replacement pliable tube therein, and wherein each of said axle support means includes a plurality of arms extending radially outward from said inner housing, said arms engaged in projections disposed on a rotatable turntable wherein the rotation of said turntable displaces said engaged arms radially outward from said inner housing.

9. The bagging device of claim 1 further comprising a releasable pliable tube abutment surface and means for disposing said abutment surface against the narrow portion of said inner housing wherein said abutment surface maintains said pliable tube in position on said inner housing.

10. The bagging device of claim 9 wherein said means for disposing said abutment surface against said inner housing includes at least one sliding bar positioned at the proximal end of said outer housing, said abutment surface disposed on said sliding bar for releasably engaging said pliable tube.

11. A bagging device for transferring material from a first chamber through an opening in a wall to a second chamber, said bagging device comprising:

an outer housing having open proximal and distal ends, said proximal end communicating with said opening;

an inner housing spaced concentrically within said outer housing so as to define an annular space therebetween, said inner housing having open proximal and distal ends so as to define a passage between said first and second chambers;

means for sealably coupling the respective distal ends of said inner and outer housing in sealing said annular space at the distal portion thereof;

a pliable tube slidably engaged in sealed relationship with said inner housing and disposed thereon within said annular space, said pliable tube including a first closed end portion extending over the proximal end of said inner housing in sealed relation thereto for receiving material from said first chamber through said inner housing, wherein the closed proximal portion of said tube is sealed and severed along said seal in providing a sealed container for handling said material while forming a second closed end portion extending over the proximal end of said inner housing in maintaining isolation between said first and second chambers; and a releasable pliable tube abutment surface and means for disposing said abutment surface against the narrow portion of said inner housing wherein said abutment surface maintains said pliable tube in position on said inner housing and wherein said means for disposing said abutment surface against said inner housing is pivotally coupled to said outer housing extending radially outward from said inner housing and engaging protrusions on a rotatable turntable wherein the rotation of said turntable displaces said protrusions causing said abutment member to be positioned radially about said inner housing.

12. A bagging device for transferring material from a first chamber through an opening in a wall to a second chamber, said bagging device comprising:

an outer housing having a distal end and a proximal end, said proximal end communicating with said opening;

an inner housing spaced concentrically within said outer housing and including proximal and distal ends corresponding to those of said outer housing, said inner housing defining a passage extending from said first chamber to said second chamber and having a narrow portion of smaller outer circumference adjacent the proximal end thereof and a wide portion of greater outer circumference toward the distal end thereof;

means for sealably securing said inner housing to said outer housing at the respective distal ends thereof, said inner and outer housings and said securing means defining an annular chamber therebetween having a closed distal end and an open proximal end; and a pliable tube having open distal and closed proximal ends corresponding to those of said inner and outer housings and slidably engaged in sealed relationship with said inner housing and disposed thereon within said annular space, said pliable tube having alternating areas of narrow and wide circumference forming pleats, said pleats allowing said pliable tube to collapse upon itself for positioning in said annular space, said closed proximal end of said pliable tube extending from the open proximal end of said annular chamber and over the proximal opening of said inner housing in forming a closure with respect thereto for receiving material from said first chamber, with said pliable tube slidably positioned on the narrow portion of said inner housing in facilitating the mounting of a replacement pliable tube on the wide portion of said inner housing in preventing the movement of air and gas between said chambers.

* * * * *